US006467569B2

(12) United States Patent
Noe et al.

(10) Patent No.: US 6,467,569 B2
(45) Date of Patent: Oct. 22, 2002

(54) SPARK ARRESTING MUFFLER WITH EXHAUST PATH PARALLEL TO MUFFLER CENTERLINE

(75) Inventors: Albert M. Noe, Macedonia; Eric G. Kindel, Cleveland, both of OH (US)

(73) Assignee: Supertrapp Industries, Cleveland, OH (US)

( * ) Notice: Subject to any disclaimer, the term of this patent is extended or adjusted under 35 U.S.C. 154(b) by 86 days.

(21) Appl. No.: 09/766,340

(22) Filed: Jan. 19, 2001

(65) Prior Publication Data

US 2002/0096392 A1 Jul. 25, 2002

(51) Int. Cl.[7] ..... F01N 3/02

(52) U.S. Cl. ..... 181/231; 181/230; 181/252; 181/256

(58) Field of Search ..... 181/250, 251, 181/252, 255, 258, 230, 231, 256, 268, 275, 278, 282

(56) References Cited

U.S. PATENT DOCUMENTS

| | | | | |
|---|---|---|---|---|
| 734,749 | A | 7/1903 | Rauch | |
| 855,913 | A | 6/1907 | Webster | |
| 951,770 | A | 3/1910 | Miller | |
| 1,040,628 | A | 10/1912 | Cormack | |
| 1,059,910 | A | 4/1913 | Russell et al. | |
| 1,266,255 | A | 5/1918 | Harris | |
| 1,351,698 | A | 8/1920 | Shuman et al. | |
| 2,045,135 | A | 6/1936 | Hanson | |
| 2,954,839 | A | 10/1960 | Gibel | |
| 3,779,340 | A | * 12/1973 | Hoffman et al. | 181/231 |
| 3,779,342 | A | 12/1973 | Broberg, Jr. | |
| 3,880,252 | A | 4/1975 | Mucka | |
| 3,987,867 | A | 10/1976 | Moller | |
| 4,090,583 | A | 5/1978 | Leonard | |
| 4,093,110 | A | 6/1978 | Johnson | |
| 4,113,051 | A | 9/1978 | Johnson | |
| 4,119,174 | A | 10/1978 | Hoffman | |
| 4,424,882 | A | 1/1984 | Moller | |
| 4,541,506 | A | 9/1985 | Venning et al. | |
| 4,598,791 | A | 7/1986 | Bates | |
| 5,869,793 | A | 2/1999 | Berger et al. | |
| D424,492 | S | 5/2000 | Bryant et al. | |

FOREIGN PATENT DOCUMENTS

| | | |
|---|---|---|
| DE | 472635 | 2/1929 |
| FR | 361310 | 6/1906 |
| FR | 777240 | 2/1935 |
| SE | 42642 | 3/1912 |

OTHER PUBLICATIONS

Supertrapp 1988 Automotive Catalog, pp. 1–12.

* cited by examiner

*Primary Examiner*—Khanh Dang
(74) *Attorney, Agent, or Firm*—Fay, Sharpe, Fagan, Minnich & McKee, LLP

(57) ABSTRACT

An engine muffler and spark arrestor includes an outer tube extending along an axis and having an inlet end and an outlet end. A plurality of substantially identical nested discs are disposed coaxially adjacent the outlet end of the outer tube. Each of the discs has a centrally located aperture. Each of the discs also has at least one slot extending therethrough. An end cap is disposed on a distal end of the set of discs. The end cap has a solid central portion which forces at least a portion of an exhaust gas flowing from an internal combustion to which the muffler is connected to flow radially outwardly along interstitial spaces defined between each pair of discs and then flow axially in a direction approximately parallel to a longitudinal axis of the muffler.

21 Claims, 5 Drawing Sheets

SPARK ARRESTING MUFFLER WITH EXHAUST PATH PARALLEL TO MUFFLER CENTERLINE

BACKGROUND OF THE INVENTION

It is well known that substantial muffling of internal combustion engines is necessary in order to reduce objectionable noise. However, it is desirable to reduce the level of exhaust noise without seriously interfering with exhaust outflow. A large variety of mufflers have been developed to meet these twin objectives for internal combustion engines.

In some environments where internal combustion engines are used, it is mandatory that the emissions of glowing carbon particles from the exhaust be prevented so as to avoid fires in the surrounding environment. This is particularly true in applications such as off-road motorcycles or "dirt bikes". A spark arresting muffler capable of catching and retaining sparks of carbon and the like discharged by the engine is necessary in such an environment because any sparks which might otherwise escape to the surroundings pose a fire hazard. Various arrangements have been provided for this purpose. One such design is shown in U.S. Pat. No. 3,987,867, issued on Oct. 26, 1976. Another such design is illustrated in U.S. Pat. No. 4,113,051, which issued on Sep. 12, 1978. Both of these patents are owned by the assignee of the instant application.

The known muffler and spark arrester designs have an enclosure including a perforated inner tube which is coaxially located within an outer tube. A sound absorbent material is placed between the tubes. At the outlet end of the inner and outer tubes, there is provided a gas barrier wall with a partially toroidal concave configuration. Against this wall nests a plurality of partially toroidal circular discs slightly spaced apart by edge dimples.

Another known engine muffler and spark arrester includes an oval shaped outer tube which is coupled to a plurality of substantially identical nested oval shaped discs. This design is illustrated in U.S. Pat. No. 5,869,793, dated Feb. 9, 1999 and also owned by the assignee of the instant application. All three of these patents are incorporated into this specification by reference in their entireties.

All three of the muffler designs illustrated in the patents referenced above, as well as a variety of competitive products, are so configured that the exhaust gases from the internal combustion engine to which the mufflers are fluidly connected exit radially around the outside diameters of the discs. However, such an exhaust path does not meet certain government noise regulations which limit the exhaust angle. More particularly, the Japanese Ministry of Transportation has a standard which requires that the exhaust from the muffler must exit within 30° of the centerline of a motor vehicle. Even decreasing the exhaust angle at the outer edges of the known discs will not necessarily comply with this standard due to the angle at which the muffler may be mounted on the motorcycle or other vehicle in relation to the longitudinal axis of the vehicle.

Accordingly, it has been considered desirable to develop a new and improved muffler system which would overcome the foregoing difficulties and others while providing better and more advantageous overall results.

BRIEF DESCRIPTION OF THE INVENTION

In accordance with one aspect of the present invention, an engine muffler and spark arrester is provided.

More particularly, in accordance with this aspect of the invention, the muffler comprises an outer tube extending along an axis and having an outlet end. A plurality of substantially identical nested discs is disposed coaxially adjacent the outlet end of the outer tube. Each of the discs has at least one slot extending therethrough. The at least one slot of each of the plurality of discs allows an approximately axial exit of at least a portion of the exhaust outflow of an associated engine to which the muffler is connected.

In accordance with another aspect of the present invention, a tunable engine muffler is provided.

More particularly, in accordance with this aspect of the invention, the muffler comprises an outer tube extending along an axis and having an outlet end. An outlet cap is secured to the outlet end of the outer tube. The outlet cap has a centrally located aperture extending therethrough. A plurality of substantially identical nested discs are disposed coaxially adjacent the outlet cap. A first of the plurality of discs is located adjacent the outlet cap. An end cap is located adjacent a last of the plurality of discs. The end cap and the plurality of discs each include at least one slot through which at least a portion of the exhaust gases from an internal combustion engine to which the muffler is connected can flow in an approximately axial direction which is offset from an axial center line of the muffler.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
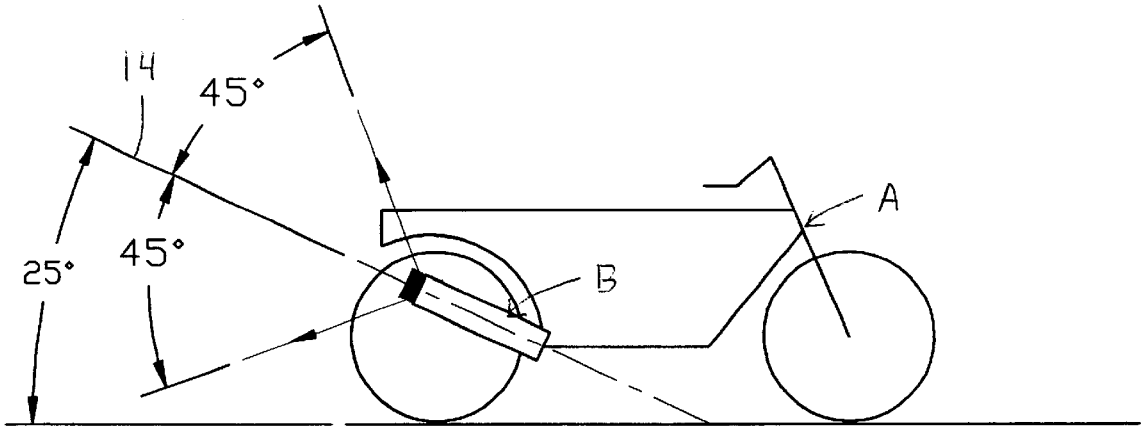
FIG. 1 is a schematic side elevational view of a motorcycle employing a muffler.

Referring now to the drawings, they are for purposes of illustrating a preferred embodiment of the invention only and not for purposes of limiting same. FIG. 1 shows a motorcycle A employing a muffler B according to the present invention. While the muffler B is illustrated as being used on a motorcycle, it should be appreciated that the muffler can be employed with other vehicles such as automobiles and trucks. In addition, the muffler according to the present invention can also be employed in other vehicular environments such as with jet skis, race boats and the like. Moreover, the muffler illustrated herein could also be employed in a variety of industrial environments to muffle the noises of industrial engines.

Figure 2:
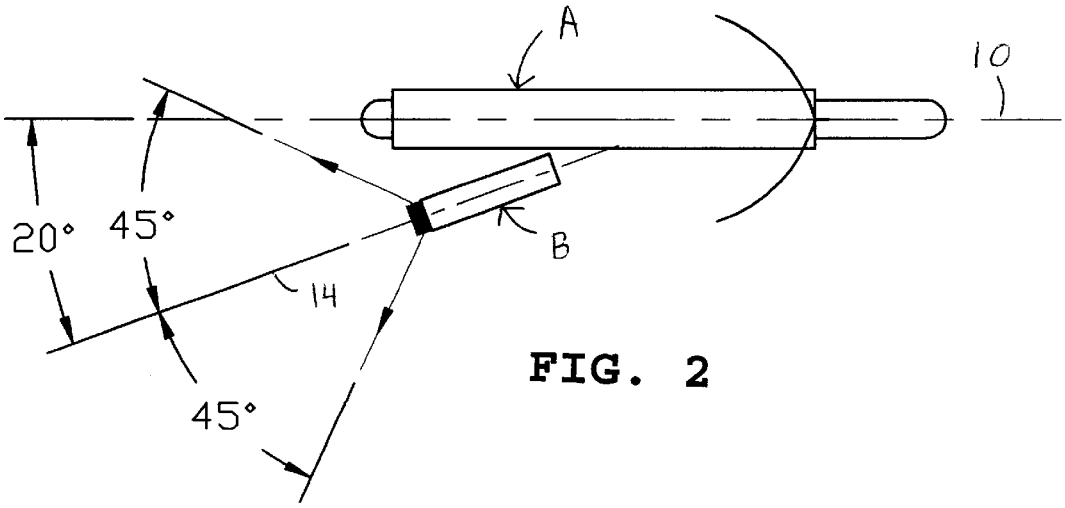
FIG. 2 is a schematic top plan view of the motorcycle of FIG. 1.

FIG. 2 illustrates the motorcycle A as having an axis 10 and the muffler B as having an axis 14. It is apparent from the top view of FIG. 2 that axis 14 of the muffler B is at an angle of approximately 20° in relation to the axis 10 of the motorcycle A. In addition, as illustrated in FIG. 1, the axis 14 of the muffler B is oriented at an angle of approximately 25° in relation to the ground surface supporting the motorcycle. Thus the total offset of the muffler axis 14 in relation to the motorcycle axis 10 is the combination of the displacements of muffler axis 14 in relation to the motorcycle axis 10 and the air exhaust direction in relation to the muffler axis as illustrated in FIGS. 1 and 2. When both of these displacements are taken into consideration, the muffler no longer meets the requirement of certain statutory noise regulations which limit the exhaust exit angle of the muffler. More particularly, in FIG. 1, the air exhaust direction from the muffler is anywhere from 5°–60° in relation to the motorcycle's axis around the periphery of the disc. Similarly, in FIG. 2, the air exhaust direction ranges from 5°–65° in relation to the axis of the motorcycle. Thus, some of the exhaust directions do not meet certain government regulations. As mentioned, one such regulation is that propounded by the Japanese Ministry of Transportation. This regulation states that the exhaust must exit within 30° of the centerline of the muffler, and the regulation presumes that the longitudinal axis of the muffler aligns with the longitudinal axis of the motorcycle.

Figure 4:
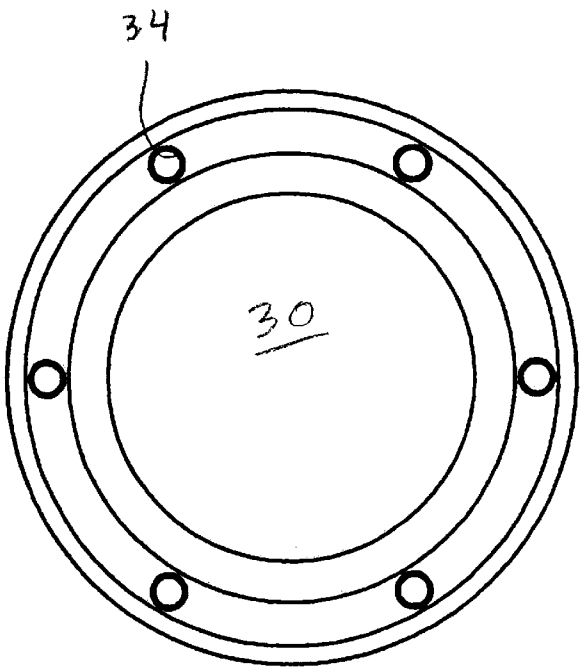
FIG. 4 PRIOR ART
FIG. 4 is an end elevational view of the muffler of FIG. 3.
Figure 3:
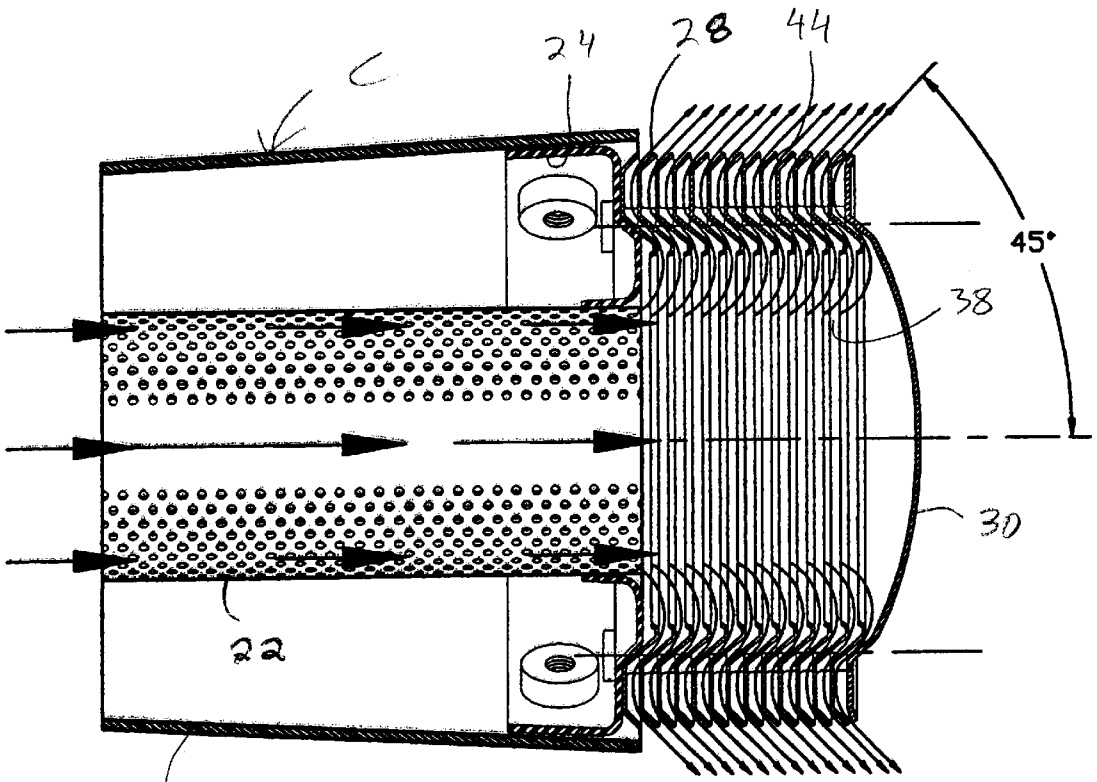
FIG. 3 PRIOR ART
FIG. 3 is an enlarged side elevational view, partially in cross section, of a prior art muffler employing a plurality of discs.

A conventional spark arresting muffler C is illustrated in FIG. 3. This muffler comprises an outer tube 20 and an inner tube 22. The two tubes are secured via an exit end cap 24. Positioned adjacent the exit end cap 24 are a plurality of discs 28 and a disc end cap 30. These elements are secured together via suitable conventional fasteners (not illustrated) extending through fastener apertures 34 in the disc end cap and similar apertures (not visible) in the discs 28. The discs are spaced apart by dimples (not visible in FIG. 3). Each of the discs has a central aperture 38. The disc end cap is, however, solid and has no aperture extending therethrough, as shown in FIG. 4. Therefore, the exhaust gases from the internal combustion engine to which the muffler is connected are forced to exit radially via exit apertures 44 defined between each two adjacent discs 28. Such an arrangement may not meet the regulations of the Japanese Ministry of Transportation, when mounted on a motor vehicle as illustrated in FIGS. 1 and 2.

Figure 5:
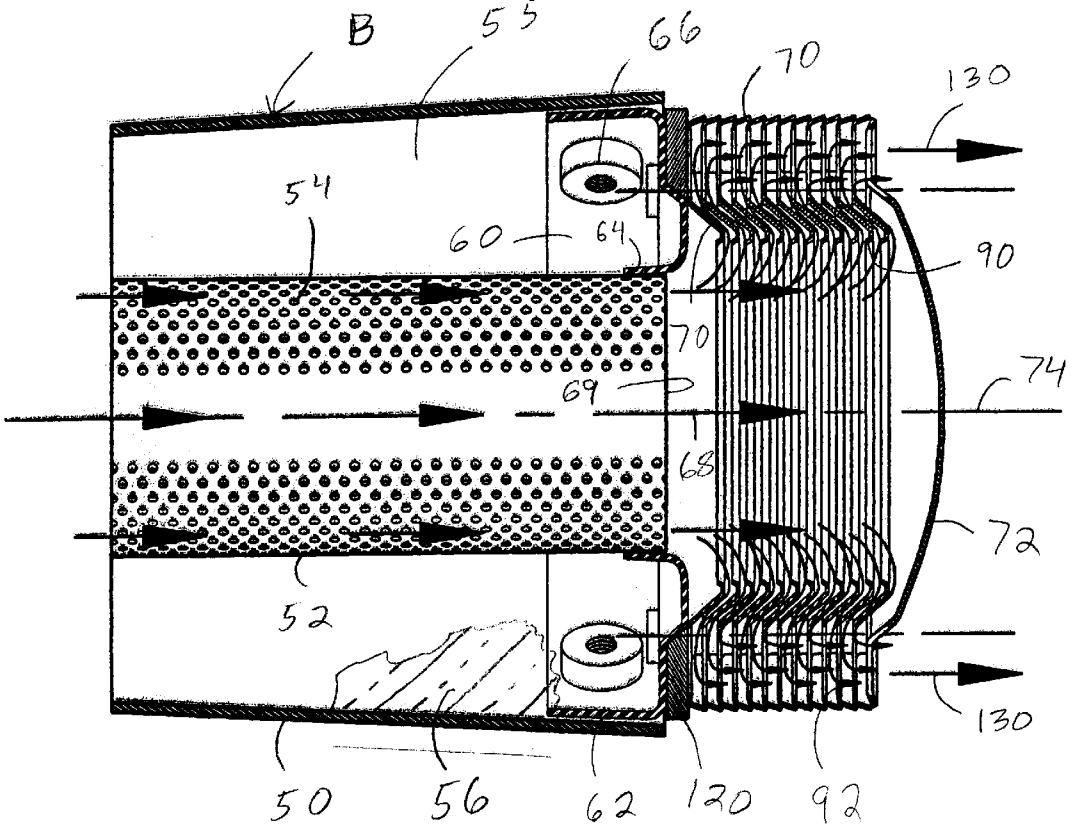
FIG. 5 is a side elevational view, partially in cross section, illustrating a muffler according to the present invention.

In response, applicants have devised the muffler B as illustrated in FIG. 5 which does meet such regulations. The muffler B comprises an outer tube 50 and an inner tube 52 which includes a plurality of apertures 54 extending therethrough. The apertures allow a certain portion of the exhaust gases to enter an interstitial space 55 defined between the inner and outer tubes. A layer of sound absorbing material 56 is positioned in the interstitial space.

An exit end cap 60 located at the exit end of the set of tubes is employed to close off the interstitial space. The exit end cap has an outer skirt 62 and an inner skirt 64. The outer skirt is secured to the outer tube 50 via suitable conventional fasteners of which a nut 66 is illustrated. The inner skirt 64 is secured to a distal end of the inner tube 52 via suitable fasteners or a conventional weld (not illustrated). Exhaust gases flowing through the inner tube 52 exit as shown by arrow 68 through an open distal end 69 of the inner tube 52. Secured to the exit end cap 60 are a set of discs 70 and a disc end cap 72. It should be apparent from FIG. 5 that the arrow 68 extends along a central axis 74 of the muffler B.

Figure 6:
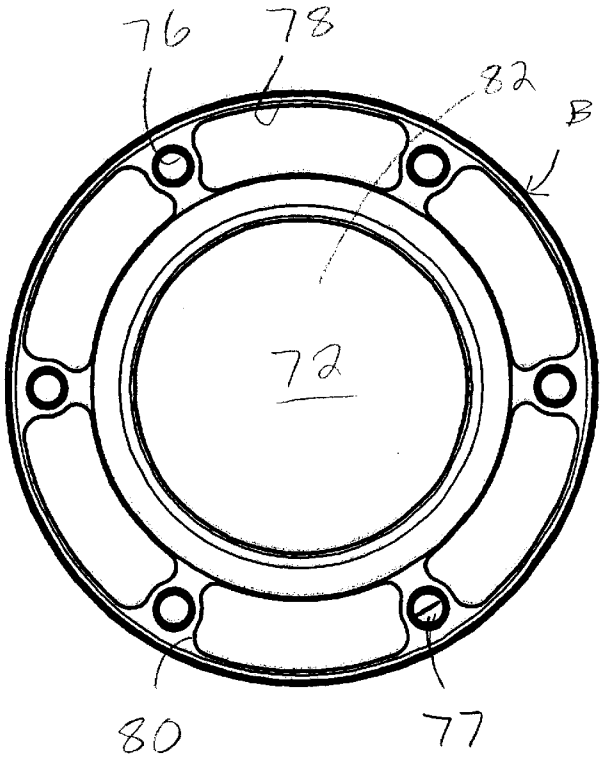
FIG. 6 is an end elevational view of the muffler of FIG. 5.

With reference now also to FIG. 6, the disc end cap 72 includes a plurality of fastener receiving apertures 76 which each accommodate a suitable fastener 77. A set of elongated slots 78 is located in a radially outer portion 80 of the disc end cap 72 in a spaced manner from the apertures 76. However, a central portion 82 of the disc end cap is solid, having no apertures extending therethrough.

Figure 7:
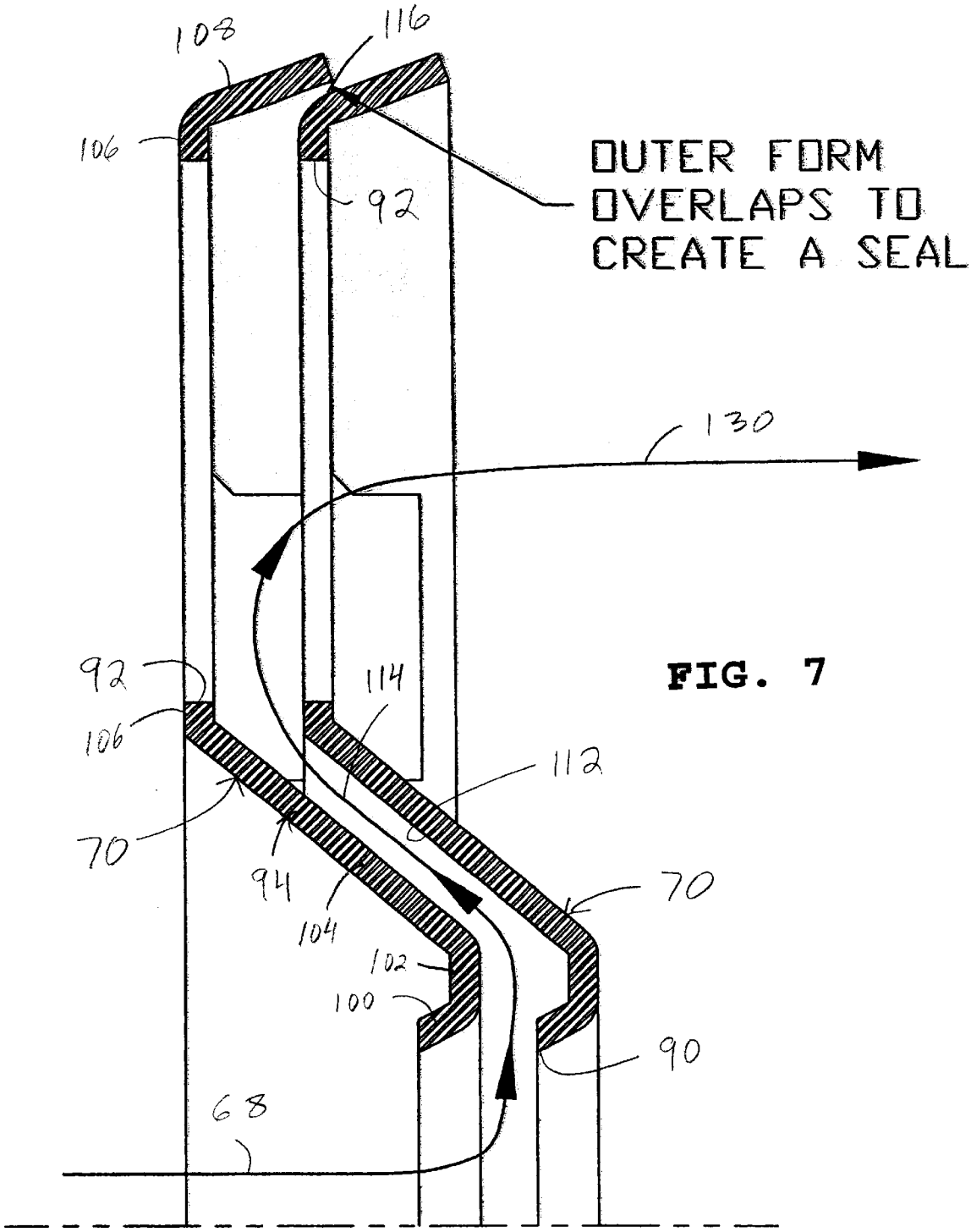
FIG. 7 is a greatly enlarged side elevational view in cross section of a portion of the muffler of FIG. 5.

With reference again to FIG. 5, each of the discs 70 includes a central aperture 90 as well as a set of elongated slots 92 which are aligned with the elongated slots 78 in the end cap 72. With reference now also to FIG. 7, the elongated slots 92 are located in a scalloped ring portion 94 of the discs 70.

More particularly, the scalloped ring portion includes a first wall section 100, a second wall section 102, a third wall section 104, a fourth wall section 106 and a fifth wall section 108. The wall sections are oriented at acute angles in relation to each other. It is noted that the second and fourth wall sections 102, 106 are located in aligned planes which are positioned approximately perpendicular to the axis 74 (FIG. 5) of the muffler.

The solid central portion 82 of the disc end cap prevents a gas flow through this dome-shaped portion of the end cap. However, flow can occur through the slots 78 disposed radially outwardly of the central portion 82. Thus, the central flow path defined through the set of discs 70 by the central apertures 90 is blocked by the end cap solid central portion 82.

An exhaust gas from the internal combustion engine to which the muffler is connected is allowed to flow between the discs in a channel 112 defined between each pair of adjacent discs 70 as illustrated by arrow 114. The exhaust gases then flow through the aligned elongated slots 92 of the discs and out through the slots 78 of the end cap 72. In this way, it can be seen that the exhaust gases of the engine are caused to flow axially then radially and then axially again. However, the second axial flow path is radially displaced from the first axial flow path. More specifically, a central axial flow is displaced radially outwardly and separated into a set of six axial flow paths. However, any desired number of flow paths could be provided. The flow path illustrated in FIG. 7 allows not only a sound attenuation of the exhaust gases, but also traps glowing carbon particles in the exhaust so as to avoid fires in the surrounding environment.

It is noted that a spacer 120 is employed between the muffler end cap 60 and the first of the discs 70 so as to seal off the elongated apertures 78 and prevent a reverse flow of the exhaust gases therethrough back toward the muffler.

As is evident from FIG. 5, a central flow path, illustrated by arrow 68, extends through the set of discs 70. However, this flow path is closed by the solid central portion 82 of the end cap 72. The exhaust gas from the internal combustion engine to which the muffler C is connected is forced to flow radially outwardly and then forced to flow axially as shown by arrows 130. Several flow paths are defined through the discs 70 and the end cap 72, one for each set of aligned slots 92 and 78. Thus, a single central flow path is replaced by a radially spaced set of off center flow paths. The set of flow paths may be aligned with the axis of the central flow path, as shown in FIG. 5. However, the set of off center flow paths could extend at an acute angle to the axis 74 of the muffler if so desired.

It should be appreciated that the diffuser discs 70 and the disc end cap 72 can be either round, oval, elliptical or of any desired shape. As mentioned, the diffuser discs illustrated in FIGS. 5 through 7 were developed to direct the exhaust flow along an axis approximately parallel to the axis of the muffler to which they are attached. By directing the exhaust gases along such an axis, the muffler and disc assembly will be compliant with various regional sound and exhaust flow regulations while maintaining the ability to tune the muffler.

While the slots 92 in the discs 70 are shown as all being aligned in the several discs, it would also be feasible to produce a muffler in which the slots would not be aligned. Such a design, although not optimum from a fluid flow standpoint, may be advantageous under certain circumstances. In the embodiment of FIGS. 5–7, misalignment of the slots 92 in the several discs 70 cannot occur because the slots are provided between each two fastener apertures 76. Thus, no matter how the discs 70 are rotated, the slots 92 of the several discs are always aligned.

As shown in FIG. 7, the diffuser disc 70 has an outside diameter which is designed to seal against another mating disc and to direct the exhaust flow out through the apertures or slots rather than radially between the discs as in the prior art muffler of FIG. 3. To this end, a gap 116 between each pair of adjacent discs 70 is minimized or eliminated altogether so as to direct a majority of the exhaust flow, if not all of it, axially rather than radially out of the muffler C.

The muffler design illustrated in FIGS. 5–7 nevertheless satisfies the requirement propounded by the United States Forestry Service in its Spark Arrestor Guidelines.

The gap between the discs tunes the exhaust. By increasing or decreasing the number of discs, this open area is changed, which will increase or decrease exhaust flow. The size of the elongated apertures or slots 92 and 78 was developed to maximize flow while maintaining the structural integrity of the discs. However, the numbers, shapes and sizes of the slots can be modified in production to enable the muffler to fulfill the requirements of certain applications.

According to the present invention, a series of discs with a precise gap form an exhaust outlet for the muffler. By adding or subtracting discs, a person can tune the internal combustion engine and the carburation of the vehicle. Adding discs opens the system, increases the exhaust outlet size and makes the vehicle noisier. Removing discs closes the system, decreases the exhaust outlet size and makes the vehicle quieter. The opening and closing of the exhaust exit is important to tuning. It allows a person to adjust the power band of the vehicle, which is especially important for racing. The addition and subtraction of discs is equivalent to changing a header or collector size.

The muffler according to the present invention disperses exhaust gases axially rather than radially as in the prior art. In spite of such axial outflow of exhaust gases, the muffler is effective in reducing noise levels while at the same time not interfering with the performance of the vehicle engine. Moreover, the instant muffler serves the purpose of trapping glowing carbon particles from the exhaust within the muffler so as to avoid fires in the surrounding environment. In other words, the instant muffler serves as a spark arrestor capable of catching and retaining sparks of carbon and the like discharged by the internal combustion engine to which the muffler is connected.

Figure 8:
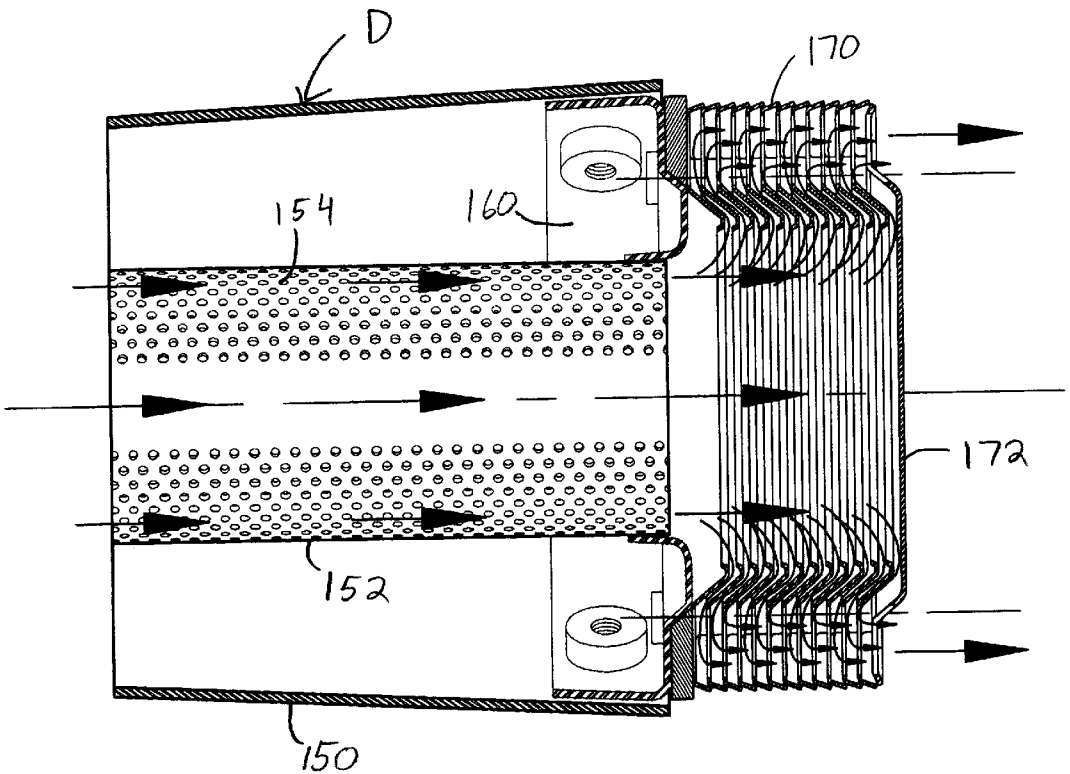
FIG. 8 is a side elevational view, partially in cross section, illustrating a muffler according to another embodiment of the present invention; and, FIG. 9 is an end elevational view of the muffler of FIG. 8.

With reference now to FIG. 8, a muffler D is there illustrated according to another embodiment of the present invention. The muffler D comprises an outer tube 150 and an inner tube 152 which includes a plurality of apertures 154 extending therethrough. An exit end cap 160 is located at an exit end of the pair of tubes and is employed to close off the interstitial space defined between them. Secured to the exit end cap are a plurality of discs 170 as well as a disc end cap 172.

Figure 9:
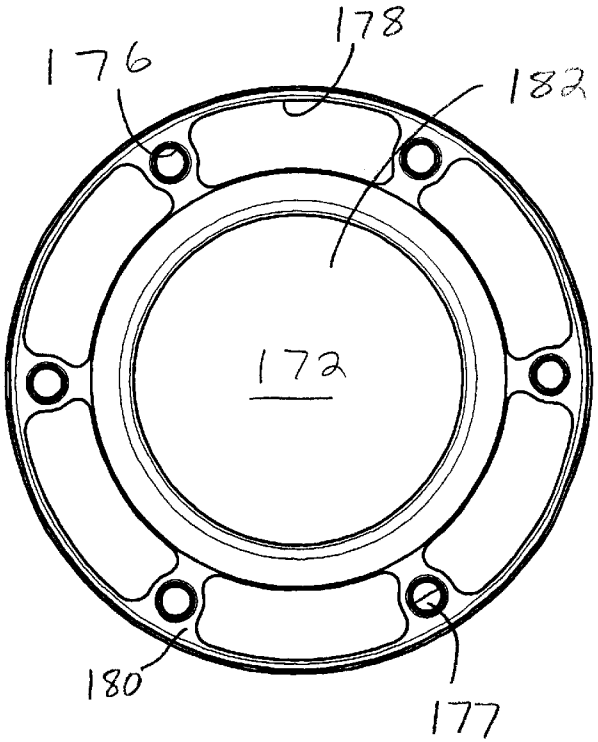

With reference now also to FIG. 9, the disc end cap 172 includes a plurality of fastener receiving apertures 176 which each accommodate a suitable fastener 177. A set of elongated slots 178 is located in a radially outer portion 180 of the disc end cap 172 in a spaced manner from the apertures 176. However, a central portion 182 of the disc end cap is solid having no apertures extending therethrough. In contrast to the embodiment illustrated in FIG. 5, the disc end cap 172 illustrated in FIG. 8 has a flat central section rather than being domed. Thus, the gap between the distal-most disc 170 and the end cap 172 is smaller than in the embodiment illustrated in FIG. 5, since the solid central portion 182 of the disc end cap 172 is not domed. This construction may be useful in certain environments.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

What is claimed is:

1. An engine muffler and spark arrester comprising:

an outer tube extending along an axis and having an outlet end; and a plurality of substantially identical nested discs disposed coaxially adjacent said outlet end of said outer tube, each of said discs having at least one slot extending therethrough, wherein the at least one slot of at least an end one of the plurality of discs is offset from an axial centerline of said outer tube, said at least one slot of said at least an end one of the plurality of discs allowing an approximately axial exit of at least a portion of an exhaust outflow of an associated engine to which said muffler is connected.

2. The muffler of claim 1 further comprising a central aperture extending through each of said discs, and wherein said at least one slot is located radially outwardly of said central aperture.

3. The muffler of claim 2 wherein said at least one slot of each of said plurality of discs is aligned with said at least one slot of each other disc.

4. The muffler of claim 1 further comprising:

a sound absorbent material disposed in a cavity defined between said outer tube and an inner tube; and a plurality of spaced apertures extending through a side wall of said inner tube to allow a flow of gas out through said side wall of said inner tube and into said cavity.

5. The muffler of claim 1 further comprising a fastener extending through a set of aligned apertures defined in respective ones of said discs to hold said discs together.

6. A tunable engine muffler comprising:

an outer tube extending along an axis and having an outlet end;

an outlet cap secured to said outlet end of said outer tube, said outlet cap having a centrally located aperture extending therethrough;

a plurality of substantially identical nested discs disposed coaxially adjacent said outlet cap, a first of said plurality of discs being located adjacent said outlet cap; and a disc end cap located adjacent a last of said plurality of discs, wherein said disc end cap and said plurality of discs each include at least one slot through which at least a portion of exhaust gases from an internal combustion engine to which said muffler is connected can flow in an approximately axial direction which is offset from an axial centerline of said muffler.

7. The muffler of claim 6 wherein said disc end cap has a central portion which is free of apertures.

8. The muffler of claim 6 wherein said discs each further comprise an axial spacing means.

9. The muffler of claim 6 further comprising a fastener extending through a set of aligned apertures defined in respective ones of said discs to hold said discs together.

10. The muffler of claim 6 wherein said disc end cap comprises a domed central section.

11. The muffler of claim 6 wherein said disc end cap comprises a planar central section.

12. The muffler of claim 6 further comprising an inner tube nested within said outer tube.

13. The muffler of claim 12 further comprising:

a sound absorbent material disposed in a cavity defined between said inner tube and said outer tube; and, a plurality of spaced apertures extending through a side wall of said inner tube to allow a flow of gas out through said side wall of said inner tube and into said cavity.

14. The muffler of claim 6 wherein each of said plurality of discs includes a central aperture and wherein said at least one slot is located radially outwardly of said central aperture.

15. The muffler of claim 14 wherein said at least one slot of each of said discs is aligned with said at least one slot of each other disc.

16. An engine muffler comprising:

an inner tube extending along an axis and having an outlet end;

an outer tube coaxial with the inner tube and having a larger diameter than the inner tube to define an interstitial space therebetween;

an outlet cap secured to said outlet end of said inner tube and said outer tube, said outlet cap having a centrally located aperture extending therethrough;

a plurality of substantially identical nested discs disposed coaxially adjacent said outlet cap, wherein a first of said plurality of discs is located adjacent said outlet cap;

a disc end cap located adjacent a last of said plurality of discs;

a fastener for securing said disc end cap and said plurality of discs to said outlet cap;

wherein said disc end cap and said plurality of discs each include at least one slot through which a portion of exhaust gases from an internal combustion engine to which said muffler is connected can flow in an approximately axial direction which is offset from an axial center line of said muffler.

17. The muffler of claim 16 wherein each of said plurality of discs includes a central aperture and wherein said at least one slot is located radially outwardly of said central aperture.

18. The muffler of claim 17 wherein said at least one slot of each of said discs is aligned with said at least one slot of each other disc.

19. The muffler of claim 16 wherein said disc end cap has a central portion which is free of apertures.

20. The muffler of claim 19 wherein said disc end cap central portion is domed.

21. The muffler of claim 19 wherein said disc end cap central portion is planar.

* * * * *